United States Patent [19]

Casamayor

[11] 4,248,018

[45] Feb. 3, 1981

[54] PLASTIC MULTIPLE TRACK WINDOW WITH SLIDEABLE AND REMOVEABLE PANES, AND ELEMENTS THEREOF

[75] Inventor: Jorge Casamayor, Columbus, Ohio

[73] Assignee: Plaskolite, Inc., Columbus, Ohio

[21] Appl. No.: 912,078

[22] Filed: Jun. 5, 1978

[51] Int. Cl.[2] ..... E06B 1/04

[52] U.S. Cl. ..... 49/504; 49/63; 52/202

[58] Field of Search ..... 52/202, 476; 49/63, 49/406, 456, 504

[56] References Cited

U.S. PATENT DOCUMENTS

| | | | |
|---|---|---|---|
| 2,999,279 | 9/1961 | Lauer | 49/434 |
| 3,110,531 | 11/1963 | Nowicki | 49/435 |
| 3,360,893 | 1/1968 | Wattelez | 52/202 |
| 3,455,080 | 7/1969 | Meadows | 52/476 |
| 3,939,620 | 2/1976 | Bero | 52/476 |
| 3,943,662 | 3/1976 | Rosen | 52/202 |
| 4,065,900 | 1/1978 | Eggert | 52/476 |
| 4,069,641 | 1/1978 | De Zutter | 52/476 |

FOREIGN PATENT DOCUMENTS

| | | | |
|---|---|---|---|
| 1559954 | 1/1972 | Fed. Rep. of Germany | 52/202 |

*Primary Examiner*—James A. Leppink
*Assistant Examiner*—Henry E. Raduazo
*Attorney, Agent, or Firm*—Kenyon & Kenyon

[57] ABSTRACT

A multiple track window, preferably with extruded plastic framing and glazing sealing strips, is described. Glazing panels are releaseably held and slideable for opening within side framing channels which are formed by releaseably interlocking members which may be integrally hinged to one another. The glazing panels are also directly removeable from the channels formed. Sealing strips with tubular protrusions are attached to adjacent edges of the glazing panels and provide a seal at their central meeting. Such a sealing strip is also adapted for use as a sill sealing strip. Thus, a tightly sealable and efficient insulating window formed from improved elements in accordance with the disclosure is provided. The glazing panels of the window may be opened to adapt to climactic conditions or ventilation requirements, or may be removed for cleaning, maintenance or other reason.

16 Claims, 15 Drawing Figures

Fig. 1.
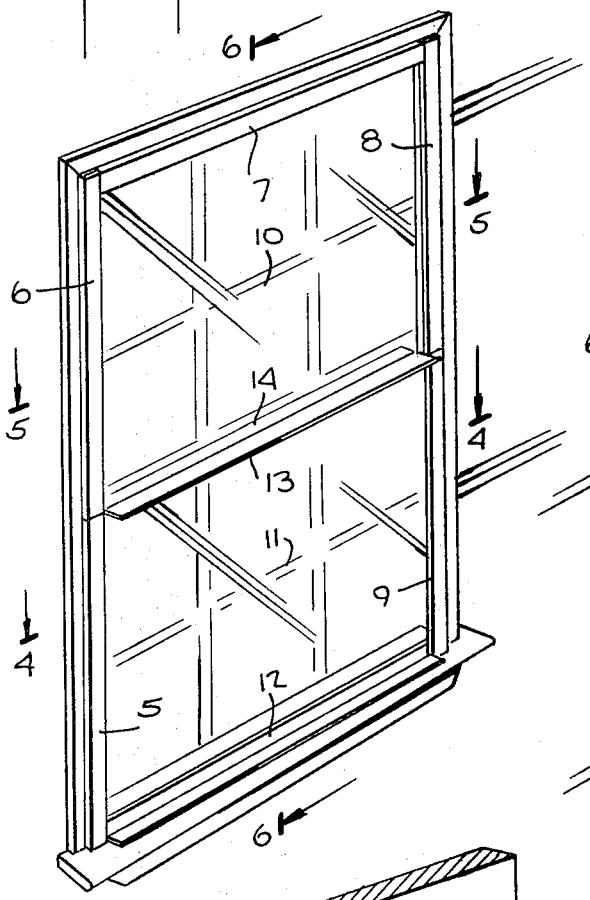
Fig. 10.
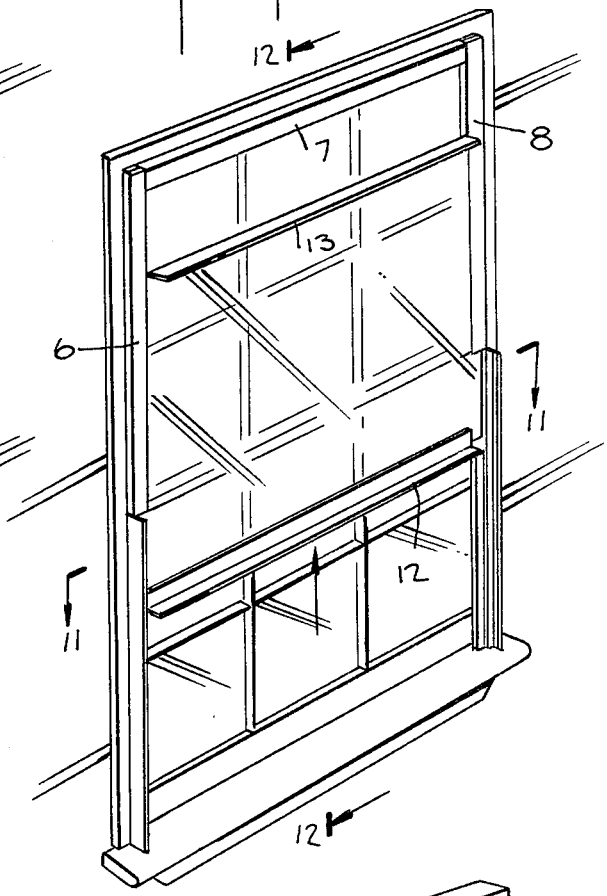
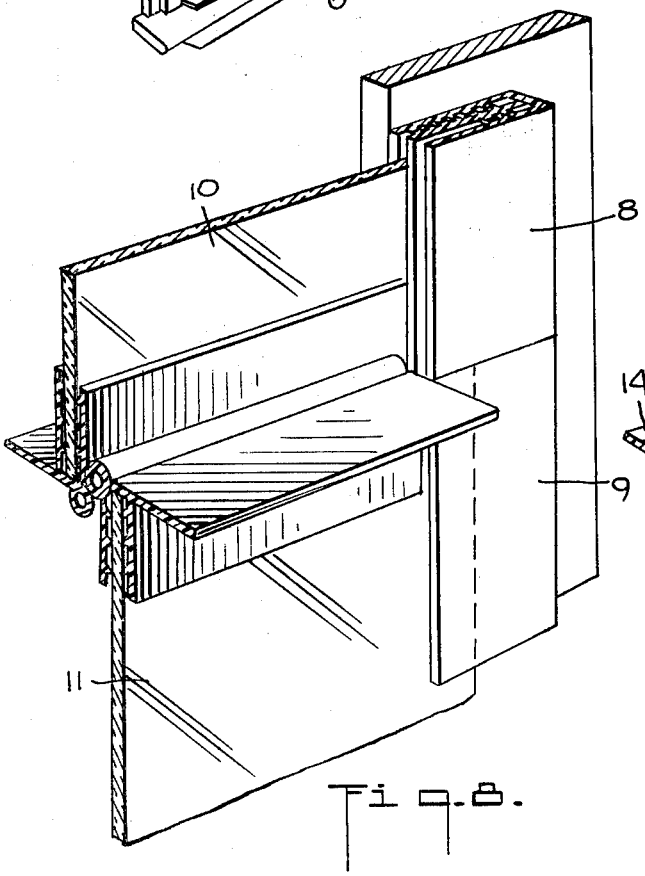
Fig. 8.
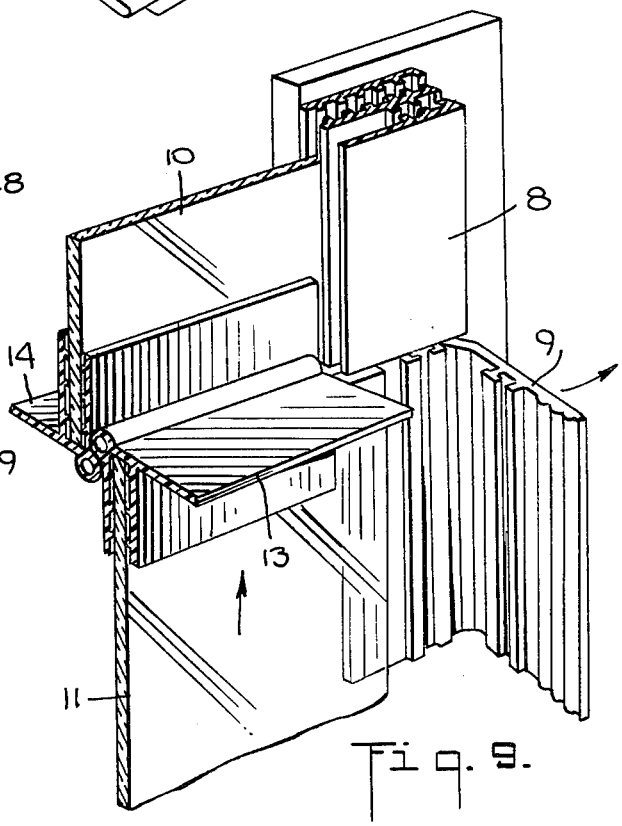
Fig. 9.

Fig. 3A.
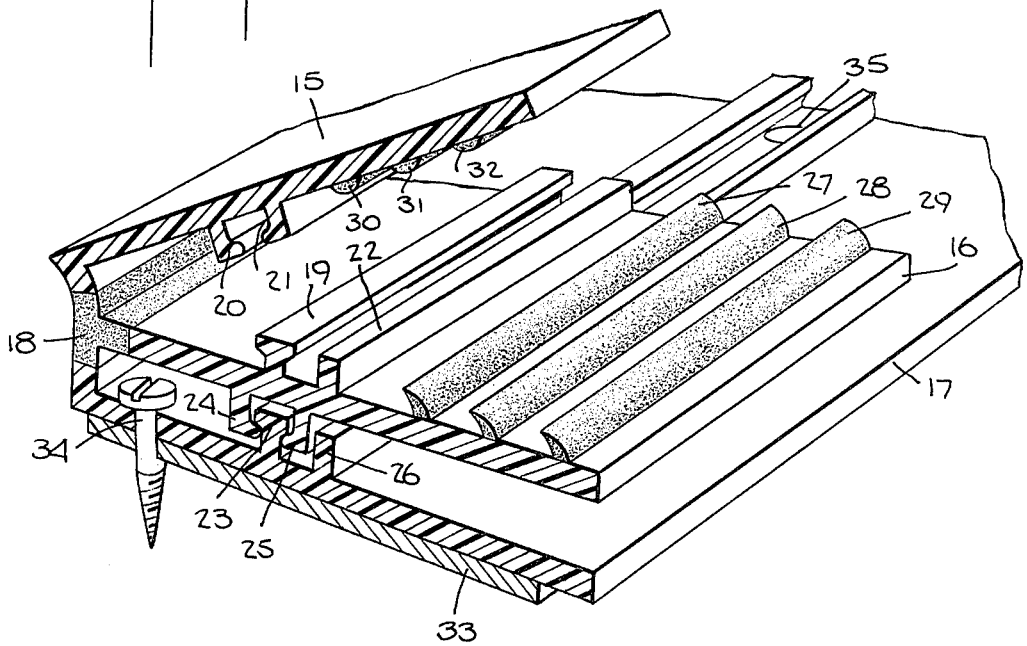
Fig. 3B.
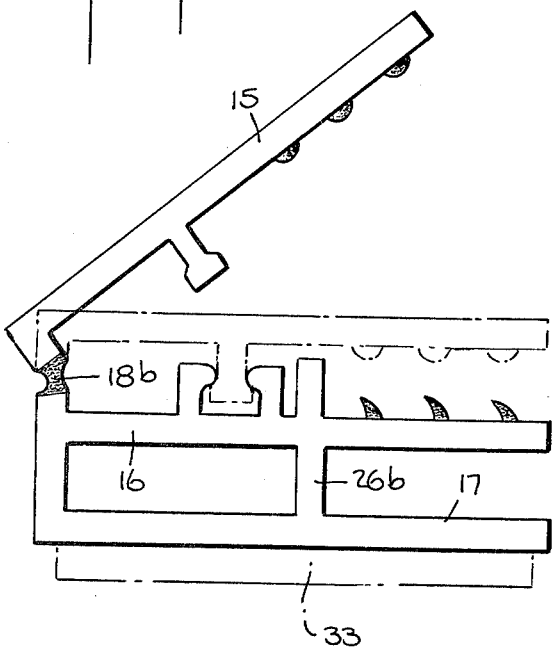
Fig. 3C.
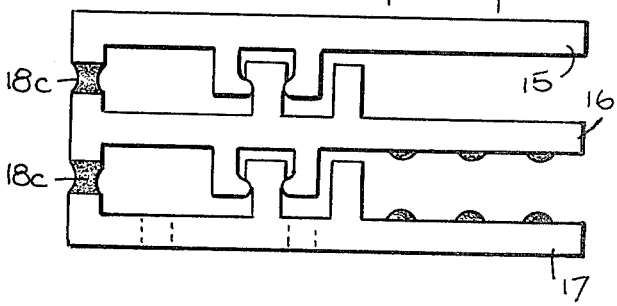
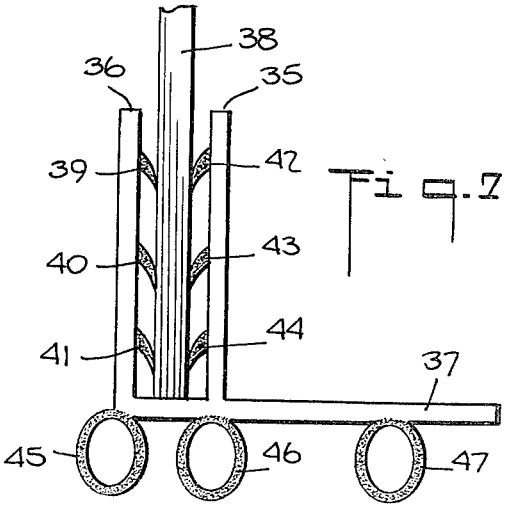
Fig. 7.

PLASTIC MULTIPLE TRACK WINDOW WITH SLIDEABLE AND REMOVEABLE PANES, AND ELEMENTS THEREOF

BACKGROUND OF THE INVENTION AND DESCRIPTION OF THE PRIOR ART

This application describes my invention of a new extruded plastic window construction having openable panes.

In the prior art there have been many types of insulating windows manufactured for installation on existing window frames. These have included exterior mounted storm windows, usually aluminum, with glass panes framed in aluminum channels which ride on multiple tracks, and which may be opened or closed. Such multiple track windows may also include screens for use while a window is open.

As is well known, the typical exterior aluminum storm window is costly and includes many parts, including separate frame and sash members to hold the glazing or screening panels, top, side and sill rails, as well as tracked inside rails within which the framed window and screen panels slide.

In addition to conventional storm windows, plastic flim has been applied with tape or other webbing to the exterior of an existing window for sealing and insulating purposes. Exterior plastic film applied to the outside of a window, while providing a high degree of insulation, however, is neither very attractive nor durable. Further it does not allow the opening of the window in fair weather, and in effect, permanently seals the window.

There have also been interior insulating windows which generally consist of a transparent plastic panel or sheet held to the interior window frame by extruded plastic or other panel holding strips. See, for example, U.S. Pat. Nos. 3,939,620 and 4,069,641.

While many interior insulating windows are less expensive than the typical exterior aluminum storm windows, and generally more durable and attractive than film applied to the exterior, the interior type of insulating window consisting of a transparent plastic glazing panel secured to the window frame, may also result in a relatively permanently sealed window because such windows are not adapted to open and close occasionally during appropriate climactic conditions or seasonal weather changes, or for ventilation purposes.

Attempts have also been made to fabricate openable sashless plastic windows, such as the two track window described in U.S. Pat. No. 3,858,356. This type of window includes two separate panes, each in its own track, comprising a window which can be opened and closed by sliding the glazing panels up or down in their respective tracks. Such windows, however, are mounted within a separate box frame, and thus do not appear to be suitable for installation as an insulating window on an existing frame, but appear adapted to be used as replacements for prime windows.

Further, such windows include sashless panes riding in extruded finger strips. This requires a relatively critical fit of the panes with respect to the finger strips. If such strips are tight with respect to the pane, the pane may not slide well; friction and abrasion may wear the edges of the pane and the strips down. If the strips are loose, to allow the pane to slide easily, a poor air seal results, and a holding device may be necessary to hold an opened pane. Otherwise, it may be necessary to form the finger strips of teflon or silicone plastics, which are so expensive that the economic advantages of the designed extruded plastic window are defeated. In addition, a good seal of the strips against the casement is necessary to prevent air leakage or infiltration. And further, such types of windows do not allow the glazing panes to be easily removed for cleaning, replacement, or other maintenance. Hence, it is difficult in such windows to provide either optimium durability, insulation, or facility in use.

All such windows, if not particularly adapted for installation as "stock" sizes must further be either custom made or fitted to the size of a particular window. In view of the difficulties of these types of insulating windows, there has existed a need for a relatively inexpensive, attractive, durable and easily operated, openable extruded plastic window which is simply and easily fitted to accommodate to the pre-existing opening of a prime window.

SUMMARY OF THE INVENTION

The window of my invention has solved the foregoing problems which have existed in the prior art. The present invention provides a tightly sealed insulating window which allows full exploitation of the insulating potential of the window yet permits the window pane to be easily opened to adapt to seasonal, climactic, or environmental conditions, or for ventilation purposes.

The present window is comprised of a number of separate elements which are preferably extruded plastic. At the pre-determined window opening at which the window is to be installed, the framing members and panes may be measured and cut "on site." Accurate installation is thus facilitated and neither complex tools nor significant skill is required. Hence, an optimum installation on an existing frame is easily achieved by even the average home handy person. Further, becuase the frame members and panes are easily cut and sized inventory and stock requirement problems are minimized. A kit may be provided in a limited number of sizes allowing for custom installation on practically any size prime window. Also the elements of the window of the invention are easily adapted for commercial job applications in which many different size insulating windows are required at one building site. Framing and glazing members may be cut from commercial stock size lengths and panels.

The present invention may be internally mounted, thus facilitating installation, cleaning, and maintenance during any weather or seasonal condition. Further, the insulating window of the invention provides a gasket seal which is substantially air tight to hold the window in its optimum insulating mode when it is closed.

Hence, the window provides the economy of extruded plastic construction in a durable mounting with significantly improved utility over known types of plastic windows.

In accordance with the invention a dual pane openable window is provided in which frameless glazing panes are tightly gasket sealed to provide optimum insulation when the window is closed. The panes are held at their normally vertical side edges in dual track mounting strips installed around the perimeter of an opening or prime window frame. The mounting strips include three protruding extruded elements which form two channels, one a holding channel including a tightly sealed air gasket which seals a pane when the window is closed, the other a sliding channel having plane inner surfaces within which a pane is slideable for opening.

A further gasket strip is applied to each remaining normally horizontal edge of the two panes. The panes are sealed at their central location, and at the sill, if necessary to adapt to an existing prime window. The channel defining elements of the holding channel are releasably interlockable, to allow the window to open, by sliding into a communicating channel, or to allow removal of the pane.

When the interlock of the holding channel of the mounting strip is released, the pane becomes slideable vertically into the plane channel of a vertically communicating strip on the side edges of the window. When the pane is slidingly opened to its desired position, the holding channel is re-interlocked, firmly holding the opened pane at its desired position.

In addition, the interlocking feature of the mounting strips permit each pane to be easily removed from its holding or sliding channel for maintenance or other reasons.

The invention is more particularly described by reference to the drawings and following description of the preferred embodiment.

BRIEF DESCRIPTION OF THE DRAWINGS

FIG. 1 is a front view of the window of the invention installed on the interior side of the frame of an existing prime window.

FIGS. 3A, and 3B and 3C detail cross-sections and perspectives of the channel forming members of the invention.

FIG. 7 is a detail cross-section view of central joining strips of the window, also used as a sill sealing strip.

FIG. 8 depicts the relationship of the separate panes of the window and the sealing central moldings where the panes meet in the center when the window is closed.

FIG. 9 is a detail view of one side of the window molding in the first step of opening the window.

FIG. 10 depicts the lower pane of the window in its openable position.

DESCRIPTION OF PREFERRED EMBODIMENT

Figure 2:
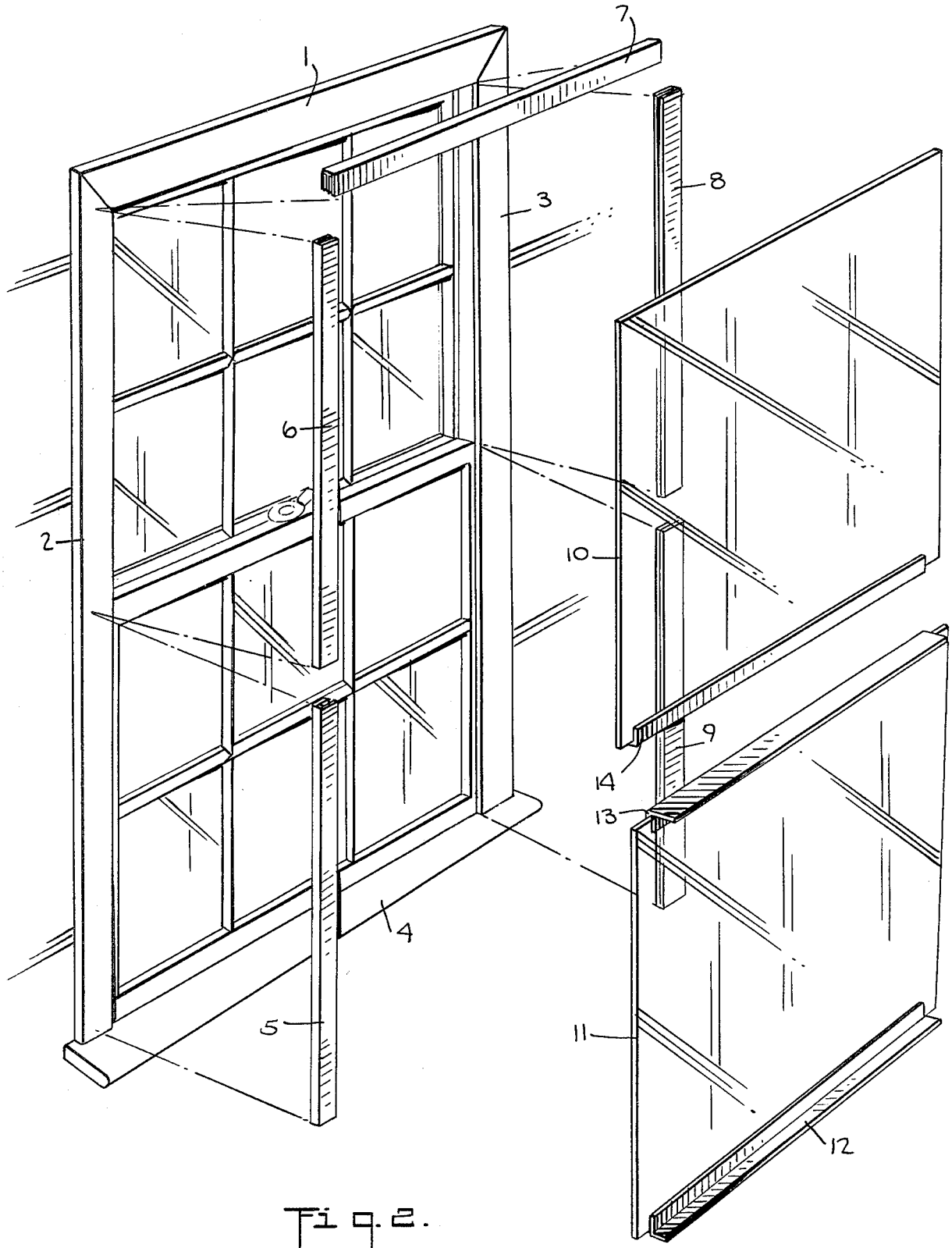
FIG. 2 is an exploded view of the separate elements comprising the window with respect to their installation at the prime window.

Through this description the same reference numerals are used in each different drawing to indicate the same element identified by the number when first used.

FIG. 1 depicts an installed embodiment of this invention when the window is closed and the panes are sealed. By reference to FIG. 2, the numerals more clearly indicate the separate elements assembled to complete the window installation. In FIG. 2, a prime window on which the invention is installed is depicted. The prime window has a header indicated by 1, side framing, 2 and 3, and sill 4. While a particular form of conventional window is shown, there are many other types of windows or wall openings to which the invention may be applied in accordance with the invention, including prime windows without sill members. Hence, more generally the window of the invention is intended to be installed around the perimeter of an opening in a building wall on a plane surface. Thus, as set forth below, in some applications the window of the invention may not be installed in conjunction with a prime window.

The window of the invention includes two panes, surrounded about their perimeter by separate strips. In the embodiment of the invention depicted in FIG. 2 installed on a window having a protruding sill, framing strip elements 5, 6, 7, 8 and 9, more particularly described below, are permanently applied to the sides and header of the prime window opening. It is in the framing strip elements that the two glazing panes, upper pane 10, and lower pane 11 are sealingly held when the window is closed, and slideable in a channel therein when it is desired that the window be opened. In silled windows, sill strip 12 is employed at the bottom edge of the lower pane, to effect a seal against the sill when the pane is closed. If the prime window is without a sill a length of the same stripping as elements 5 and 9 is installed at the prime window bottom to complete a perimeter around the existing window opening.

Where the two panes meet in the middle of the window, a seal is effected by central jointer strips 13 and 14 applied to the bottom edge of the upper pane, 14, and the top edge of the lower pane, 13.

In FIG. 3A, elements of molding frame strips 5, 6, 7, 8 and 9 are more clearly depicted in perspective. The molding strips are extruded plastic having three rigid channel forming elements extending from a common back. The side edge portions of the panes are held within the channels formed. A releaseable interlock allows opening and closing of the channels of the molding. The channel forming elements consist of first and second outer members indicated in the figures by reference numerals 15 and 17. The outer members are each disposed parallel with a co-extensive central member 16 and form two channels to receive the glazing panes. One channel, between elements 15 and 16 is releaseably interlockable and includes gasket sealing elements on the inner surfaces of the channel to effect an air seal for a pane. The second channel, between elements 16 and 17, includes plane interior surfaces which allow a pane to slide therein. In the strip of FIG. 3A, the outer elements 15 and 17 are hinged by a common hinge element 18 to the central member to allow each channel formed to be opened and closed. For the sealing channel, a releaseable interlock is effected between outer member 15 and central member 16, by a shoulded rib or barb, 19 extending from the central member, co-operating with communicating pair of receiving ribs 20 and 21 in the outer member. A rib on either channel member may perpendicularly extend therefrom to provide a protective barrier between the edge of the pane held and the interlock to prevent abrasion or other interference between such elements. Such a protective rib is depicted at 22.

A releaseable interlock for the second channel is also provided between the central member 16 and second outer member 17 by means of the rib or barb, 23, releaseably interlockable with the co-operating pair of communicating ribs 24 and 25 which receive the barb, 23. The protective rib in the second channel is indicated at 26. While a barb and rib type interlock is depicted, other means for interlocking extending linear elements will be apparent to those skilled in the extrusion art and may suitably be adapted for use as means for interlocking in the strips of the invention.

An alternate embodiment of the framing strip is depicted in FIG. 3B in which only one member forming the gasket sealing channel is releaseably interlockable. In this embodiment, as depicted in FIG. 3B rib **26*b* permanently joins the central member to the second outer member to form a fixed, rigid channel in which the pane is slideable. A hinge element 18*b*, centrally located at the width of the holding channel in the back of the framing strip, joins the outer member 15 to the central member 16**.

A further alternative is to provide separate hinge elements between the members forming each channel. Such an alternative is depicted in FIG. 3C, in which two separate hinge elements, **18*c***, join each outer element with the central member.

With further reference to FIG. 3A, one channel defined by the frame strip to receive a side edge of the glazing pane is a sealing and holding channel and includes feathered, 27, 28 and 29, or rounded, 30, 31 and 32, protrusions, or a combination thereof as illustrated, to provide a gasket seal for the pane held. These protrusions are softened, cushioned material to provide a gasket air seal between the surface of the pane and the strip when the window is closed. In addition, these protrusions firmly and grippingly hold the pane in a desired position when the window is opened.

Preferably, the second channel of the framing strip defined by the second outer member, 17, and central member 16, includes plane inner surfaces in which the pane is slideable.

Hence, three rigid members extending from a common back form two channels in a single framing strip to receive the edges of the glazing panes of the window.

Preferably, the framing member is co-extruded from polyvinyl chloride to produce a dual durometer strip. As is known in co-extrusion art, in making the strip, a rigid and flexible vinyl are fed into separate intake manifolds of an extruder and are simultaneously extruded thru the same die at the portions of the die corresponding to the intended feature of the extrusion which is to utilize the type of fed vinyl. The rigid vinyl forms the rigid channel forming elements, 15, 16 and 17, each intrinsically including respective interlock means and protective ribs. A softer flexible vinyl forms the hinge element 18, joining the rigid channel forming elements and gasket sealing protrusions, 27, 28, and 29 and 30, 31 and 32.

The selection of an appropriate rigid and flexible vinyl for co-extrusion is made in accord with the known skill of the art, depending on the design parameters and intended environmental conditions of use for any particular strip application.

Substitution of other plastics is possible. Polypropylene or high density polyethylene, both relatively rigid plastics with good hinging qualities may be used in making the framing strips. These plastics may preferably be utilized in accordance with the examples depicted in FIGS. 3B and 3C. Separate foamed insulating tape may be applied in the inner surfaces of the sealing channel of such strips.

It is also possible to dispense with the hinge and employ separate interlocking elements; however, a hinged interlock is preferred because its intrinsic one piece construction reduces the risk of loss of the elements comprising a framing strip, effects a better, more secure seal and allows easier use of the window.

Regardless of the manner in which the framing strips are made, the strips are applied around at least the vertical sides of the perimeter of the prime window or wall opening. As stated previously, a prime window with a sill would not include a framing strip of the type of FIG. 3 at the sill. Conventional means, such as the double backed adhesive tape shown at 33, may be used. Screws, nails, sealant glue or adhesive, or other suitable means may also be used to affix the channel forming strips to the prime window frame or to the wall around the opening intended to be covered by the window of the invention.

Screws, nails or rivets, would preferably be inserted through the strip adjacent the back opposite the channel forming edge, such as in a series of holes in the portion of outer strip member indicated at 34 in FIG. 3A at, for example, 3" spacing. Another series of holes for such fasteners, depicted in FIG. 3A at 35, may be included in the channel between interlocking barb 23 and protective rib 26. Fasteners may be alternated between the rear channel adjacent the back and the channel between the barb and rib. In this manner, fasteners would secure the framing strip on both sides of the interlocking rib member, 23, where it is expected that the most stress would be applied to the strip in releasing the interlock to open the window, for an optimum installation. Screws or nails may also be used to reinforce the installation with double backed adhesive tape or be used in combination with other sealants or insulation to effect a gasket seal between the channel defining member and the prime window frame or opening perimeter. Depending on the linear measurement of the opening dimension, such reinforcing fasteners would be spaced, for example, at approximately 6" to 12" apart along the length of the strip.

In the installation of the framing strip about the perimeter of the prime window opening, the same extrusion may be employed for each member which makes up the perimeter around the prime window frame. Thus, frame members 5, 6, 7, 8 and 9 are identical extrusions.

Figure 4:
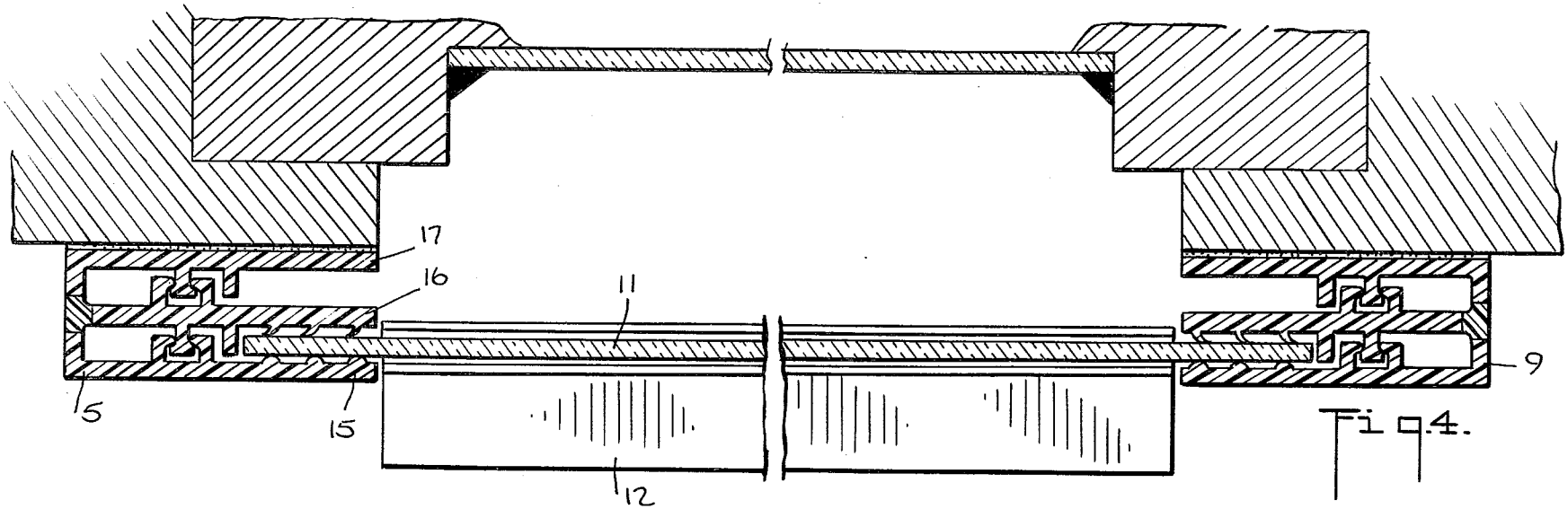
FIGS. 4 and 5 are horizontal cross-sectional views of the windows, respectively through the separate lower pane (Section 4—4 of FIG. 1) and separate upper pane (Section 5—5 of FIG. 1), showing the relationship of the elements of the window with respect to each other and the prime window.
Figure 5:
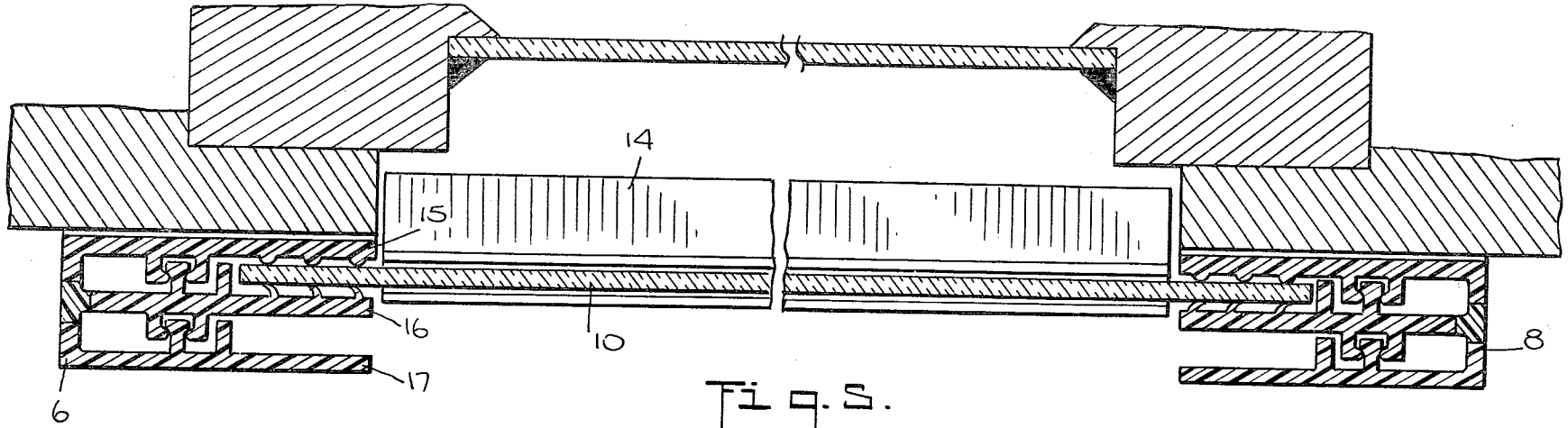
Figure 6:
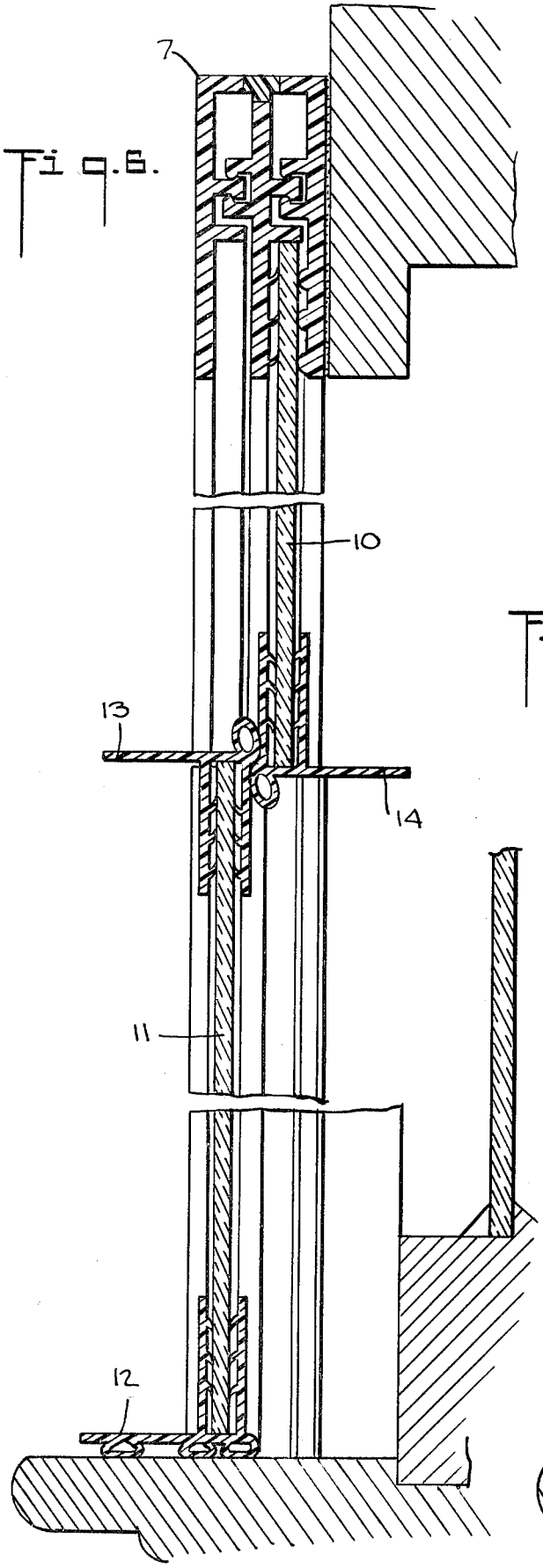
FIG. 6 is a perspective view of a vertical cross-section of the window when closed taken through Section 6—6 of FIG. 1.
Figure 12:
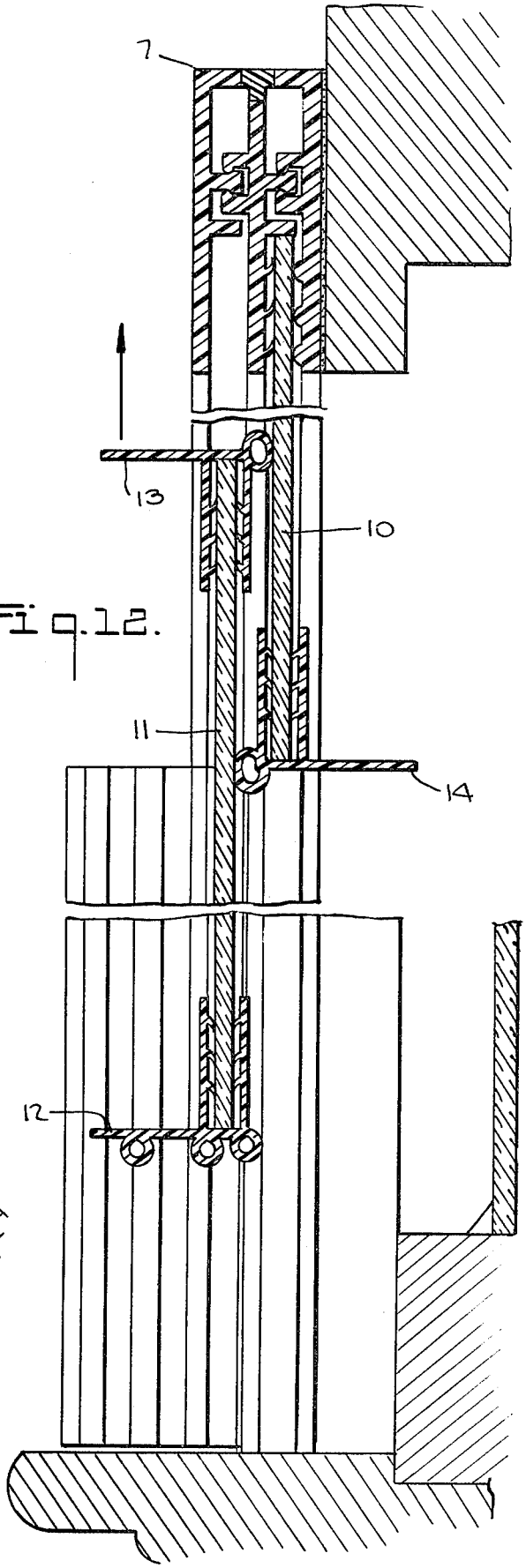

The members, however, have different orientations with respect to the extrusion depending on the upper or lower position of the member and the front or rear relationship of the pane with respect to the channel of a particular member. This is illustrated by the vertical cross-section of FIG. 6 and the horizontal cross sections of the window through the upper pane, depicted in FIG. 5, and the lower pane, depicted in FIG. 4. In FIG. 6, it is seen that the panes have a front and rear relationship. FIG. 4 depicts the front lower pane, 11, held in the front gasket sealing channel of framing strips 5 and 9. FIG. 5 depicts the rear upper pane 10 held in a rear gasket sealing channel of framing strips 6 and 8.

The side framing strips 6 and 8 are vertically aligned with, but reversely applied with respect to side strips 5 and 9. In this manner the front holding and sealing channel of strip 5 is aligned to correspond with the front sliding channel of strip 6 and vice versa. Similarly on the other side strips 8 and 9 are so aligned. This vertical alignment of the strips at the side edges of the window is depicted in FIG. 9, in which it can be seen that the front sealing channel of frame member 9 corresponds to the front sliding channel of member 8 which receives glazing pane 11. With reference to the detail drawing of the framing strip of FIG. 3A, in the installed window of FIG. 1, it is apparent that strips 5 and 9 are applied to the window framing with channel forming member 17 adjacent the frame, while strips 6 and 8 are applied with member 15 adjacent the frame. Hence, while the same strips are employed, the means for attaching the strips around the perimeter of the prime window frame are applied to the opposite outer elements of the strip depending on whether the strip is an upper or lower strip. This is readily seen by a comparison of FIG. 5 with FIG. 4, respectively cross-sections of the upper and lower portions of the window. In the lower pane, the adhesive tape 33 or fastener holes 34 are applied to member 17 of the framing strips 5 and 9 in which the pane is frontally held. The upper rear pane depicted in FIG. 5 is held in a strip with attachment means included on member 15, as in strips 6 and 8.

In the embodiment depicted, the upper pane is additionally held at its top edge by framing strip 7, having the same channel orientation as strips 6 and 8.

The glazing may be extruded or cast acrylic, styrene, polycarbonate or other plastic as well as glass. Furthermore, panes may be tinted or reflective, as well as transparent to provide solar control as well as insulation.

Where the edges of the upper and lower panes meet in the center of the window, an air seal is effected by central sealing strips 13 and 14. At the sill, the seal is effected by sill sealing strip 12. The seal effected is depicted in FIG. 6. If a window of the invention were installed at a prime window without a protruding sill, a framing strip segment, corresponding to segments 5 and 9 would be employed at the bottom of the pane to effect a seal there, as is effected by framing strip 7 at the top of the window in the embodiment of FIG. 1.

Figure 13:
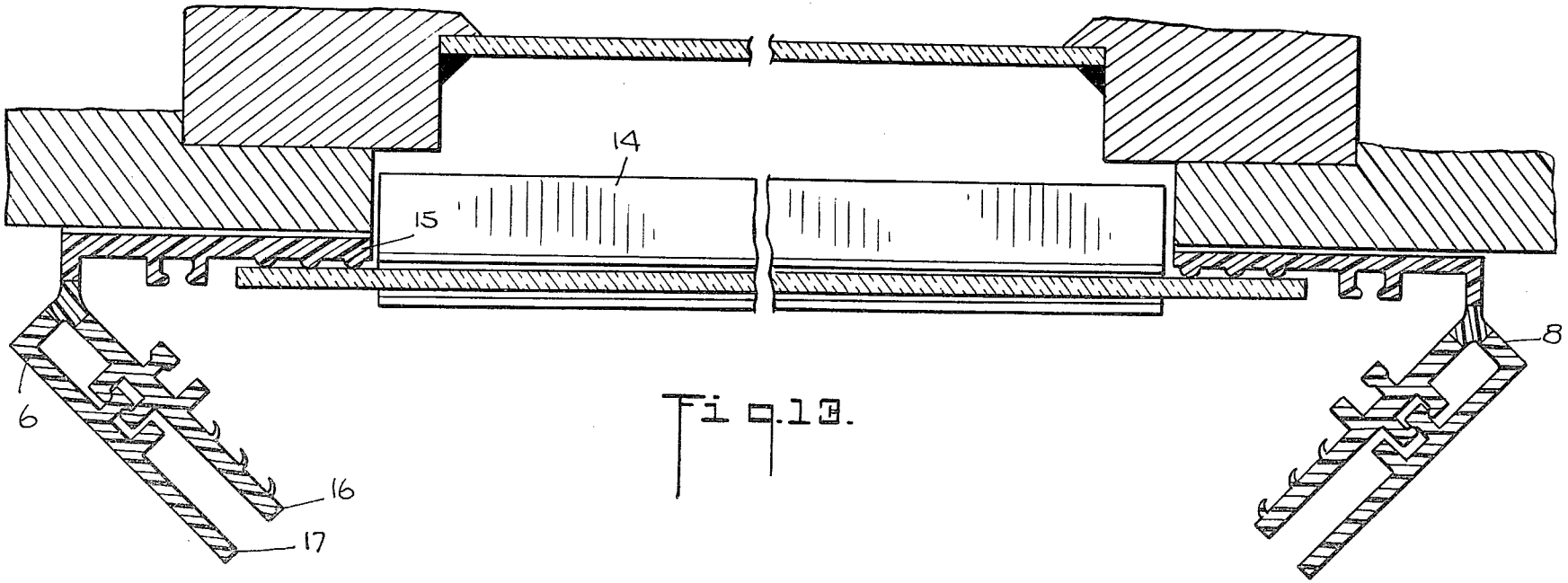
FIG. 13 is a cross-section through the upper pane of the window depicting the upper pane of the window in the first step of opening, corresponding to the depiction of FIG. 10 of the lower pane in a similar opening orientation.

The central sealing strips and sill sealing strips may also be the identical extrusion. A detail of such a strip is depicted in FIG. 7 in cross section. The strip includes channel forming elements 35 and 36, relatively parallel with each other and both relatively perpendicularly extending from a base member 37, all formed of a rigid plastic. Elements 36 and 37 form a corner and the extending elements 35 and 36 form a channel to receive the edge of a glazing pane 38. Coextrusions of a flexible plastic form gasket feathers 39, 40, 41, 42, 43, and 44 extending from elements 35 and 36 towards the inside of the channel. Co-extending tubes 45, 46 and 47 are also co-extruded along the base member from the flexible plastic. Tube 45 extends from the external corner junction of rigid element 36 and 37 while tubes 46 and 47 extend from the externally facing side of the rigid base element 37. An intrinsic strip of dual durometer is thus provided. Preferably this strip will be of a rigid and soft polyvinyl chloride selected and co-extruded in a single die in accordance with known methods. This extrusion provides a multiple purpose strip for use in the invention. The strip is used to seal the lower edge of the upper pane with the upper edge of the lower pane and seal the lower pane at the sill. Further, the extending base element 37 of the strip provides a grip for raising the lower pane of the window into the slideable channel of the upper framing strips when the window is opened as is depicted in FIG. 13.

Alternatively, the central sealing strip may include only one extending tubular gasket at the external corner thereof as is depicted in FIG. 8 and FIG. 9.

When used as a sill strip, the sealing strips described also provide an advantage over conventional sill strips in that the co-extensive flexible tubes are more adaptable to accommodate to irregular surfaces, seal a greater area, and further provide a greater surface area at the location of the seal as depicted in FIG. 5 then do co-extruded feathers or solid protrusions which are customarily used as sill strips, for example, such as those depicted in U.S. Pat. Nos. 3,939,620 or 4,069,641.

In the installation of the window of the invention at any predetermined prime window, the various frame, sealing and pane elements are sized for the particular opening, whether the window is supplied in a kit or fabricated from commercial sized stock pieces.

For a predetermined window, the window opening is divided, preferably in half, into upper and lower portions which may be separately considered. With reference again to FIG. 3 the separate upper and lower side framing member elements, 5, 6, 8 and 9 dividing the height of the window in half, are attached at the sides of the perimeter of the opening with the channels of the upper members 6 and 8, and lower members 5 and 9 aligned so that the holding channel of one communicates with the sliding channel of the other and vice versa on each side of the window. The top framing strip, 7, is attached with channels oriented corresponding to strips 6 and 8.

In a window without a sill, a bottom framing strip with channels oriented corresponding to srips 5 and 9 is attached. After the framing strips are attached to the prime window frame, an appropriate width of the glazing is determined by measurement of the inside distance between the protective ribs of the framing members on each side of the attached framing strips. An appropriate tolerance to allow sliding, decreasing the width measured by, for example, 0.125" on each side is determined and the width of the glazing can then be cut. Heightwise, the height of the window is measured from the sill (or protective rib of the bottom frame strip) to the protective rib of the header framing strip, 7. One half of this measurement is preferably the height of each glazing pane of which two are required.

The length of the central sealing strips, and sill strip, 12, if required, is determined as the distance between the inside facing edges of the framing strips. The sealing strips are centered in the glazing pane, allowing the edge of the pane to extend into the channel of the framing strip, as depicted in FIG. 9.

The panes are next installed. The rear pane, which in the example depicted is the upper pane is installed first. The rear gasket channels of the upper side strips 6 and 8 are released, as depicted in FIG. 13, as well as the header strip 7. The pane is placed therein, into the area with three sides defined by the protective ribs of frame members 6, 7 and 8 with the base of the sealing strip 14 facing rearward. The gasket channel of members 6, 7 and 8 is then interlocked and the pane is securely held in its upper position.

Figure 11:
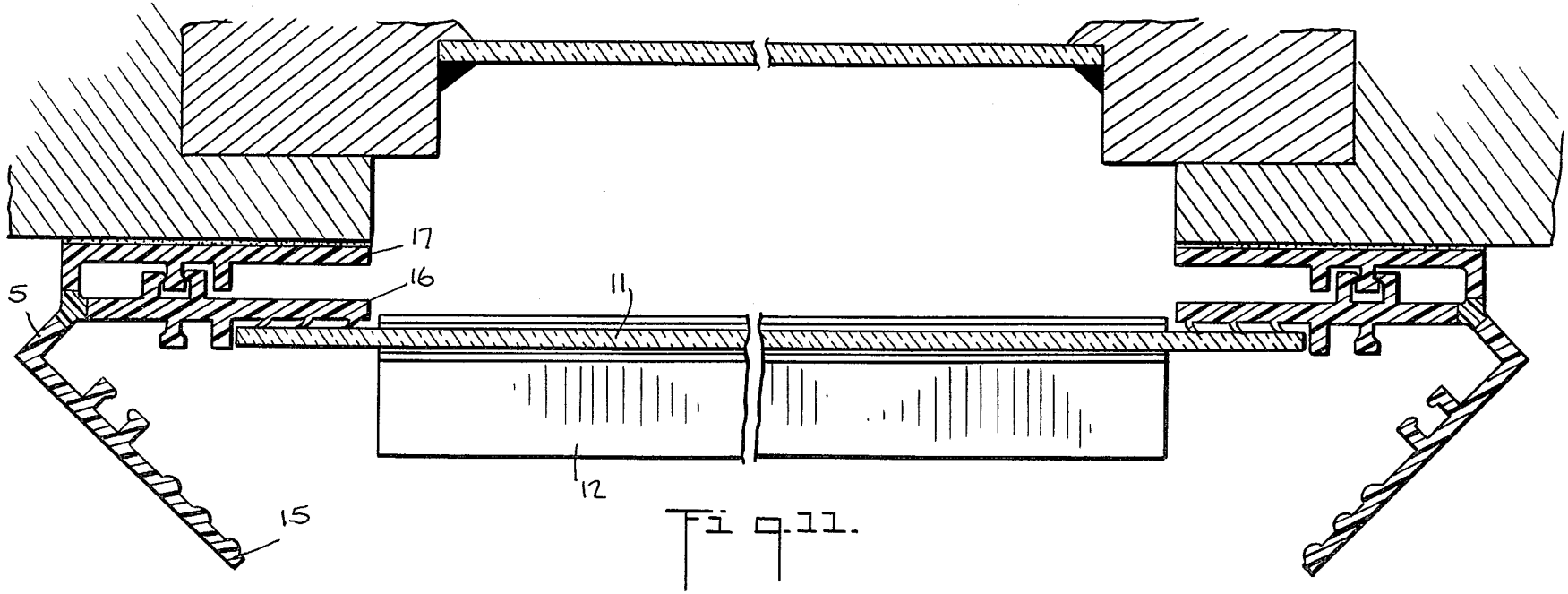
FIGS. 11 and 12 are respectively horizontal (Section 11—11 of FIG. 10) and vertical (Section 12—12 of FIG. 10) cross-section views through the window in an open position.

The lower pane is installed next in the front gasket channel of the lower framing members. The interlockable channels of strips 5 and 9 are released as depicted in FIG. 11, and the pane placed therein with the base of the sealing strips on the horizontal edges thereof, 12 and 13, extending frontwardly.

Thus, when the window is closed, a secure air seal is effected. The gaskets of strips 5 and 9 seal the side edges of lower pane 11; the side edges of upper pane 10 are sealed in strips 6 and 8; the top edge of the upper pane is sealed by strip 7; and the sill and the central pane conjunction are sealed with sealing strips 12, 13 and 14 as depicted in FIG. 6.

Having thus described the elements of construction of the window and their relationship while stationary, the operation of the window is set forth below.

In FIG. 1, the window of the invention is depicted closed. When closed, the channel forming elements are interlocked and the gasketed channels of the framing members and sealing strips provide a tight air seal as set forth above.

When it is desired to open the window, the interlocking channel which sealingly holds the pane desired to be opened is released. FIG. 9 depicts the release of the side gasket sealing channel strip in an example in which a window having a lower front pane is opened by raising the lower pane. Once the sealing channel is released on both sides, eg. elements 5 and 9 as depicted in FIG. 10 and in cross section in FIG. 11, the glazing pane is slideable upward into the corresponding plane channel of the upper framing strips. When the lower pane is raised sufficiently to its desired opening, the interlocking strips are snapped closed. The gasket will firmly hold the edges of the pane and securely maintain the window in its opened position. Alternatively, when the interlock is released, the entire lower pane is removeable.

FIG. 13 depicts the opening of the upper pane. When the gasket sealed members of the upper, side channel elements 6 and 8, and top channel element, 7, are released, the pane may be lowered into the corresponding plane channel of the lower side framing members 5 and 9. When the pane is lowered to its intended opening, the channel of the upper side framing member is closed.

In this manner, there results little friction on the edges of the glazing panel and either pane of the window may be firmly held in either an open or closed position.

In its preferred embodiment, the window of the invention is employed as an interior insulating window in conjunction with an already existing prime window. When so employed, the prime window shields the insulating window from the outside environment. Accordingly, the window may be extruded in light weight plastic. In such applications, glazing panes of extruded acrylic or styrene plastic of a thickness of 0.080–0.125" are customarily employed. A sufficient depth of the channel holding the edges of the glazing panes would be approximately 0.50" and the channel forming members would typically be 0.060" in thickness. Other dimensions for the remaining elements of the framing strips will be readily apparent given these basic dimensions.

Similarly, the sealing strip would typically have a channel 0.50" deep and be typically formed of rigid plastic 0.035" thick. The co-extensive flexible tubes would typically have 0.020" wall thickness and 0.125" diameter.

If the window of the invention were not shielded by a prime window, but used alone and exposed to weather conditions, significantly heavier gauge glazing would be required to withstand flexion caused by wind gusts and pressure. Accordingly, all other members of the window assembly would also be scaled up in size and gauge for the additional strength required to hold securely a heavier gauge glazing in view of external weather conditions.

In addition, it will be apparent that when a pane of the window is opened or removed, a screen or screening panel may be included in the open area as in any conventional window.

In the foregoing, I have described the preferred embodiment of my invention using various dimensional orientations. It will be apparent to those skilled in the art that variations of the elements described may be made without departing from the spirit of what I claim, which is the following:

1. A framing strip for a multiple track window of substantially plastic construction in which two glazing panes are held adjacent their side edges in separate channnels of side framing strip members which attach the window to a predetermined location, and the panes are moveable within and removeable from the channels of the side framing strip, in which:

the side framing strips include three rigid linearly extending extruded plastic elements, said elements being first and second outer elements disposed in a relationship with respect to a common central element in which:

an outer element is releasably interlockable by means for interlocking with the central element, and the other outer element is disposed in a parallel relationship adjacent the central element; and the three linearly extending extruded elements so disposed form two open channels between the three linearly extending elements when the outer element is interlocked with the central element;

the first channel between the releasably interlockable central element and the outer element being adapted to receive and to releasably hold and seal a first glazing pane by means for gripping the frist pane at the side edge of the pane, and the second channel being adapted to receive the second glazing pane in a sliding relationship with respect to the side edge of the pane; and in which the side framing strip members which form the two channels consist of an extruded dual durometer plastic and include a hinge portion joining the releasably interlockable rigid elements at the edge thereof opposite the open edge of the channel formed, said hinge portion further consisting of a co-extruded plastic of softer durometer than the durometer of the plastic of the rigid linearly extending elements.

2. A framing strip for a multiple track window of substantially plastic construction in which two glazing panes are held adjacent their side edges in separate channels of side framing strip members which attach the window to a predetermined location, and the panes are movable within and removable from the channels of the side framing strip, in which:

the side framing strips include three rigid linearly extending extruded plastic elements which intrinsically project from a common back portion and further include intrinsic means for laterally hinging the rigid linearly extending extruded plastic elements with respect to each other, said means for hinging including a linearly extending hinge portion disposed between said rigid element and the common back portion; and in which:

the three rigid linearly extending extruded plastic elements are first and second outer elements disposed in a relationship with respect to a third common central element in which:

both outer elements are releasably interlockable with the central element by means for interlocking with the central element;

each outer element is disposed in a parallel relationship adjacent the central element; and the three linearly extending extruded elements so disposed form two open parallel channels between the three linearly extending elements when the outer elements are interlocked with the central element;

whereby the first channel between the releasably interlockable central element and the outer element is adapted to receive and to releasably hold and seal a first glazing pane by means for gripping the first pane at the side edge of the pane, and the second channel is adapted to receive the second glazing pane in a sliding relationship with respect to the side edge of the pane.

3. The framing strip of claim 2 extruded from one of (a) high density polyethylene and (b) polypropylene.

4. The multiple track window framing strip of claim 1 or 2 in which the means for gripping in the first channel which is adapted to receive and releasably hold and seal a first glazing pane consists of at least one co-extruded extending protrusion of softer durometer plastic than the durometer of the extruded rigid plastic, the co-extruded extending protrusion being longitudinally coextensive with the length of the rigid linearly extending elements, said protrusion extending along the surface of the rigid element forming the inner surface of the channel.

5. The multiple track window frame strip of claim 4 in which the co-extruded extending protrusion consists of a feathered co-extrusion in the rigid element.

6. The multiple track window frame strip of claim 4 in which the co-extruded extending protrusion consists of a substantially half-rounded co-extrusion in the rigid element.

7. The multiple track window frame strip of claim 4 including means for fastening said frame member to a plane surface, said means including a double faced adhesive tape applied to an outer element of the side channel strip.

8. The multiple track window frame strip of claim 4 in which an outer element of the side channel includes a series of holes therein to receive fasteners which affix said strip to a plane surface.

9. A double track dual pane openable window of substantially plastic construction, including:

two substantially rectangular plastic glazing panes of common width, said panes being normally an upper pane and a lower pane when the window is closed and further being disposed in a front and rear relationship of one with respect to the other, side framing strips adjacent the panes, the framing strips having upper and lower members in correspondence with the upper and lower panes, such members having front and rear channels to receive the glazing panes at the side edges thereof, such members further comprising:

three adjacent rigid linearly extending extruded plastic elements, said elements being two outer elements disposed in a parallel relationship with a central element to form two open channels adapted to receive the side edges of the glazing panes therein, one of such channels being formed between an outer element which is releaseably interlockable by means for interlocking with the central element, such channel being adapted to releaseably hold and seal a glazing pane therein at the side edge of the pane, the outer channel being formed between the other outer element and the central element and being further adapted to receive a glazing pane in a sliding relationship with respect to the side edge of the pane the upper and lower members of the side framing strips being disposed in a relationship so that the respective channels thereof are in a front and rear relationship corresponding to the relationship of the upper and lower glazing panes and that the channel of each member adapted to releaseably hold and seal a glazing pane of one member is linearly aligned vertically to co-operate with the channel adapted to receive the glazing pane in a sliding relationship of the other member.

10. The window of claim 9 in which:

the lower pane is in front of the upper pane when the window is in a closed position, the members of the framing strips which hold the glazing panes at their side edges are disposed such that:

the lower member holds the edges of the lower pane in a front releasably interlockable channel, the upper member holds the edges of the upper pane in a rear releasably interlockable channel, the rear channel of the lower member is adapted to slidingly receive the upper pane, and the front channel of the upper member is adapted to slidingly receive the lower pane.

11. The window of claim 10 in which the side framing strips include a hinge portion joining an outer element with a releasably interlockable central element.

12. The window of claim 11 in which the side framing strips consist of a dual durometer plastic in which the hinge portion is a co-extruded element of a plastic of softer durometer than the durometer of the plastic of the rigid channel forming elements.

13. The window of claim 12 in which the side framing strips are polyvinyl chloride framing strips.

14. The window of claim 9 or 10 further including at least one dual durometer extruded plastic sealing strip attached to the edge of a glazing pane, said sealing strip consisting of:

a rigid extrusion of two rigid plastic channel forming members perpendicularly extending from a rigid plastic base member, the two channel forming members being disposed substantially parallel to each other to provide a channel between the inner surfaces of channel forming members, and one of such channel forming members being further disposed with respect to the rigid base member to form an external corner between the base member and the one channel forming member, said rigid extrusion being co-extruded intrinsically with a flexible plastic member, said flexible plastic member consisting of a tube longitudinally co-extensive with the rigid members extending from the external corner formed by the base and the channel forming member.

15. The window of claim 14 adapted for use as an interior insulating window in conjunction with a prime window having a sill, said insulating window including three sealing strips in which the upper pane of the window includes one sealing strip at its lower edge thereof and the lower pane includes a sealing strip at both its upper and lower edges thereof.

16. The window of claim 9 including a screen.

* * * * *